US012523143B2

(12) United States Patent
Chen et al.

(10) Patent No.: US 12,523,143 B2
(45) Date of Patent: Jan. 13, 2026

(54) ADDRESSING PLUG MOVEMENT IN HYDRAULIC FRACTURING

(71) Applicant: Halliburton Energy Services, Inc., Houston, TX (US)

(72) Inventors: Zhonghuan Chen, Houston, TX (US); Dinesh Ananda Shetty, Houston, TX (US); Faraaz Adil, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/919,064

(22) Filed: Oct. 17, 2024

(65) Prior Publication Data

US 2025/0369343 A1 Dec. 4, 2025

Related U.S. Application Data

(60) Provisional application No. 63/654,764, filed on May 31, 2024, provisional application No. 63/653,659, filed on May 30, 2024.

(51) Int. Cl.
*E21B 47/09* (2012.01)
*E21B 33/12* (2006.01)
(Continued)

(52) U.S. Cl.
CPC ..... *E21B 47/09* (2013.01); *E21B 43/26* (2013.01); *E21B 47/06* (2013.01)

(58) Field of Classification Search
CPC ..... E21B 47/06; E21B 47/09; E21B 43/26; E21B 33/10; E21B 33/12;
(Continued)

(56) References Cited

U.S. PATENT DOCUMENTS 4,899,320 A * 2/1990 Hearn ..... E21B 47/02 73/152.59
4,993,491 A 2/1991 Palmer et al.
(Continued)

FOREIGN PATENT DOCUMENTS

CA 3221947 1/2018
CA 3034253 1/2021
(Continued)

OTHER PUBLICATIONS

"PCT Application No. PCT/US2025/014878 International Search Report and Written Opinion", May 26, 2025, 10 pages.
(Continued)

*Primary Examiner* — Kenneth L Thompson
(74) *Attorney, Agent, or Firm* — DeLizio, Peacock, Lewin & Guerra LLP

(57) ABSTRACT

Some implementations include a method for identifying movement of a plug in a borehole of a well. The method may include obtaining, via one or more pressure sensors, pressure data indicating pressures in the borehole during stages of hydraulic fracturing; obtaining well data indicating one or more well geometries and treatment data indicating one or more treatments for hydraulic fracturing; extracting, via a plug movement detector, pressure-related features from the drilling data, well-related features from the well data, and treatment-related features from the treatment data; and outputting, by the plug movement detector, an indication whether the plug moved in the borehole based on the pressure-related features, well-related features, and treatment-related features.

21 Claims, 9 Drawing Sheets

(51) Int. Cl.
*E21B 43/26* (2006.01)
*E21B 47/06* (2012.01)

(58) Field of Classification Search
CPC ..... E21B 33/12955; E21B 33/1204; E21B 2200/22; E21B 2200/20
See application file for complete search history.

(56) References Cited

U.S. PATENT DOCUMENTS

| | | | | |
|---|---|---|---|---|
| 5,295,393 | A | 3/1994 | Thiercelin | |
| 5,441,340 | A | 8/1995 | Cedillo et al. | |
| 6,439,310 | B1 | 8/2002 | Scott, III et al. | |
| 6,795,773 | B2 | 9/2004 | Soliman et al. | |
| 6,935,424 | B2 | 8/2005 | Lehman et al. | |
| 7,210,528 | B1 | 5/2007 | Brannon et al. | |
| 7,377,319 | B2 * | 5/2008 | Patterson | E21B 23/06 73/152.59 |
| 7,451,812 | B2 | 11/2008 | Cooper et al. | |
| 7,451,820 | B2 | 11/2008 | Albers et al. | |
| 7,516,793 | B2 | 4/2009 | Dykstra | |
| 7,673,507 | B2 | 3/2010 | Walters et al. | |
| 7,938,181 | B2 | 5/2011 | Dusterhoft et al. | |
| 8,126,646 | B2 | 2/2012 | Grove et al. | |
| 8,528,649 | B2 | 9/2013 | Kolle | |
| 9,135,475 | B2 | 9/2015 | Lecerf et al. | |
| 9,222,347 | B1 | 12/2015 | Walls et al. | |
| 9,441,470 | B2 * | 9/2016 | Guerrero | E21B 43/26 |
| 9,658,357 | B2 | 5/2017 | Kabannik et al. | |
| 9,803,467 | B2 | 10/2017 | Tang et al. | |
| 9,909,404 | B2 | 3/2018 | Hwang et al. | |
| 10,001,769 | B2 | 6/2018 | Huang et al. | |
| 10,400,550 | B2 | 9/2019 | Gu et al. | |
| 10,408,029 | B2 | 9/2019 | Rodrigues et al. | |
| 10,641,090 | B2 | 5/2020 | Felkl et al. | |
| 10,677,961 | B1 | 6/2020 | Chen et al. | |
| 10,689,971 | B2 | 6/2020 | Smith et al. | |
| 10,995,609 | B2 | 5/2021 | Felki et al. | |
| 11,199,084 | B2 | 12/2021 | Langnes et al. | |
| 11,230,915 | B2 | 1/2022 | Dusterhoft et al. | |
| 11,319,790 | B2 | 5/2022 | Potty et al. | |
| 11,320,551 | B2 | 5/2022 | Liu et al. | |
| 11,415,716 | B2 * | 8/2022 | Clark | E21B 47/095 |
| 11,434,738 | B1 | 9/2022 | Han | |
| 11,518,931 | B2 | 12/2022 | Duncan et al. | |
| 11,608,740 | B2 | 3/2023 | Moos et al. | |
| 11,649,696 | B2 * | 5/2023 | Angman | E21B 23/06 166/308.1 |
| 11,668,168 | B2 * | 6/2023 | Parsegov | E21B 43/26 166/250.01 |
| 11,702,931 | B2 | 7/2023 | Inyang et al. | |
| 11,704,557 | B2 | 7/2023 | Moniruzzaman et al. | |
| 11,708,759 | B2 | 7/2023 | Jaaskelainen et al. | |
| 11,753,917 | B2 | 9/2023 | Shetty et al. | |
| 11,753,923 | B2 | 9/2023 | Dalamarinis | |
| 11,762,115 | B2 | 9/2023 | Quan et al. | |
| 11,767,751 | B2 | 9/2023 | Coenen et al. | |
| 11,808,145 | B2 * | 11/2023 | Fripp | E21B 43/261 |
| 11,879,317 | B2 | 1/2024 | Hunter et al. | |
| 12,006,819 | B2 | 6/2024 | Cramer | |
| 12,037,899 | B2 | 7/2024 | Swan | |
| 2006/0034152 | A1 | 2/2006 | Korneev et al. | |
| 2007/0007003 | A1 | 1/2007 | Jackson et al. | |
| 2010/0314104 | A1 | 12/2010 | Shokanov et al. | |
| 2013/0079935 | A1 | 3/2013 | Kabannik et al. | |
| 2014/0222392 | A1 | 8/2014 | Johnson et al. | |
| 2016/0222741 | A1 | 8/2016 | Lovorn et al. | |
| 2016/0266276 | A1 | 9/2016 | Stokely et al. | |
| 2017/0138150 | A1 * | 5/2017 | Yencho | E21B 43/14 |
| 2017/0342823 | A1 * | 11/2017 | Shah | E21B 33/12 |
| 2018/0210105 | A1 | 7/2018 | Stokely | |
| 2019/0029884 | A1 | 1/2019 | Jonkheere et al. | |
| 2019/0129047 | A1 | 5/2019 | Clark et al. | |
| 2019/0136684 | A1 | 5/2019 | Felkl et al. | |
| 2019/0146115 | A1 | 5/2019 | Mayo et al. | |
| 2019/0310386 | A1 | 10/2019 | Quan et al. | |
| 2019/0338619 | A1 | 11/2019 | Bois | |
| 2020/0063533 | A1 | 2/2020 | Annaiyappa | |
| 2020/0308958 | A1 | 10/2020 | Kabannik et al. | |
| 2021/0032967 | A1 | 2/2021 | Dusterhoft et al. | |
| 2021/0040841 | A1 | 2/2021 | Dusterhoft et al. | |
| 2021/0073342 | A1 | 3/2021 | Razavi et al. | |
| 2021/0131254 | A1 | 5/2021 | Potty et al. | |
| 2021/0140312 | A1 | 5/2021 | Dumoit et al. | |
| 2021/0189874 | A1 | 6/2021 | Jaaskelainen et al. | |
| 2021/0277760 | A1 | 9/2021 | Stephenson et al. | |
| 2021/0301657 | A1 | 9/2021 | Gordon et al. | |
| 2021/0302612 | A1 | 9/2021 | Venkatakrishnan et al. | |
| 2021/0396117 | A1 | 12/2021 | Yeung et al. | |
| 2021/0406792 | A1 | 12/2021 | Bhardwaj et al. | |
| 2022/0120173 | A1 | 4/2022 | Balan et al. | |
| 2022/0145742 | A1 | 5/2022 | Dalamarinis et al. | |
| 2022/0186605 | A1 | 6/2022 | Quan et al. | |
| 2022/0228484 | A1 | 7/2022 | Cramer | |
| 2022/0307371 | A1 | 9/2022 | Swan | |
| 2022/0325621 | A1 | 10/2022 | Moos et al. | |
| 2022/0364429 | A1 | 11/2022 | Burke et al. | |
| 2023/0009947 | A1 | 1/2023 | Ruhle et al. | |
| 2023/0066612 | A1 | 3/2023 | Parsegov et al. | |
| 2023/0086213 | A1 | 3/2023 | Yeung et al. | |
| 2023/0120763 | A1 | 4/2023 | Ray | |
| 2023/0147476 | A1 | 5/2023 | Wheelock et al. | |
| 2023/0228185 | A1 | 7/2023 | Dunham et al. | |
| 2023/0235635 | A1 | 7/2023 | Li et al. | |
| 2023/0243231 | A1 * | 8/2023 | Zakharia | E21B 43/261 166/285 |
| 2023/0296800 | A1 | 9/2023 | Zheng et al. | |
| 2023/0383639 | A1 | 11/2023 | Sridhar et al. | |
| 2023/0417940 | A1 | 12/2023 | Rose et al. | |
| 2024/0060410 | A1 | 2/2024 | Gunaratne et al. | |
| 2024/0077071 | A1 | 3/2024 | Mu et al. | |

FOREIGN PATENT DOCUMENTS

| | | |
|---|---|---|
| CA | 3034219 | 3/2023 |
| CN | 114152977 | 1/2023 |
| WO | 2009096805 | 8/2009 |
| WO | 2018022044 | 2/2018 |
| WO | 2018084871 | 5/2018 |
| WO | 2018111231 | 6/2018 |
| WO | 2021061567 | 4/2021 |

OTHER PUBLICATIONS

"PCT Application No. PCT/US2025/014882 International Search Report and Written Opinion", May 28, 2025, 10 pages.
"PCT Application No. PCT/US2024/053767 International Search Report and Written Opinion", Feb. 21, 2025, 10 pages.
"PCT Application No. PCT/US2024/053772 International Search Report and Written Opinion", Feb. 20, 2025, 10 pages.
"PCT Application No. PCT/US2024/053866 International Search Report and Written Opinion", Feb. 21, 2025, 11 pages.
"PCT Application No. PCT/US2024/054478 International Search Report and Written Opinion", Feb. 20, 2025, 9 pages.
"PCT Application No. PCT/US2024/054614 International Search Report and Written Opinion", Feb. 20, 2025, 10 pages.
"PCT Application No. PCT/US24/53771 International Search Report and Written Opinion", Feb. 25, 2025, 10 pages.
"PCT Application No. PCT/US2024/053099 International Search Report and Written Opinion", Feb. 20, 2025, 9 pages.
"PCT Application Serial No. PCT/US24/54479, International Search Report and Written Opinion", Feb. 19, 2025, 11 pages.
"U.S. Appl. No. 16/668,791 Final Office Action", Jul. 12, 2021, 14 pages.
"U.S. Appl. No. 16/668,791 Non Final Office Action", Mar. 2, 2021, 12 pages.
Carey, et al., "Analysis of Water Hammer Signatures for Fracture Diagnostics", SPE Annual Technical Conference and Exhibition, Sep. 28-30, 2015,, 2015, 25 pages.
Chen, et al., "Research on recognition and classification of pulse signal features based on EPNCC", Scientific Reports vol. 12, Article No. 6731 (2022), 2022, 11 pages.

(56) References Cited

OTHER PUBLICATIONS

Cramer, et al., "Integrating Distributed Acoustic Sensing, Treatment-Pressure Analysis, and Video-Based Perforation Imaging to Evaluate Limited-Entry-Treatment Effectiveness", SPE Production and Operations, vol. 35, Issue 04, Nov. 2020, 2020, 26 pages.
Cramer, "The Application of Limited-Entry Techniques in Massive Hydraulic Fracturing Treatments", SPE Production Operations Symposium held in Oklahoma City, Oklahoma, Mar. 8-10, 1987, 1987, 18 pages.
Crump, et al., "Effects of Perforation-Entry Friction on Bottomhole Treating Analysis", JPT vol. 40, Issue 08, Aug. 1988, 1988, 8 pages.
Dung, et al., "Practical Applications of Water Hammer Analysis from Hydraulic Fracturing Treatments", SPE Hydraulic Fracturing Technology Conference and Exhibition, Virtual, May 2021, Apr. 27, 2021, 47 pages.
Dunham, et al., "Constraints on Pipe Friction and Perforation Cluster Efficiency from WaterHammer Analysis", SPE Hydraulic Fracturing Technology Conference and Exhibition, The Woodlands, Texas, USA, Jan. 31-Feb. 2, 2023., 2023, 12 pages.
Kotthoff, "Algorithm Selection for Combinatorial Search Problems: A Survey", AI Magazine, 35 (3), 2014, 37 pages.
Long, et al., "A Perforation-Erosion Model for Hydraulic-Fracturing Applications", SPE Annual Technical Conference and Exhibition, Houston, Sep. 28-30, 2015, 2015, 15 pages.
Martins, et al., "Communication Models for Distributed Acoustic Sensing for Telemetry", IEEE Sensors Journal, vol. 17, No. 15, Aug. 1, 2017, 2017, 12 pages.
"U.S. Appl. No. 18/920,381 Non-Final Office Action", Sep. 17, 2025, 11 pages.
"U.S. Appl. No. 18/920,483 Non-Final Office Action", Sep. 25, 2025, 15 pages.
"U.S. Appl. No. 18/920,567 Non-Final Office Action", Jul. 15, 2025, 11 pages.

* cited by examiner

500

ADDRESSING PLUG MOVEMENT IN HYDRAULIC FRACTURING

TECHNICAL FIELD

Some implementations relate to operations for hydraulic fracturing in a well. More specifically, some implementations relate to plug movement in a well system.

BACKGROUND

Some processes for recovering hydrocarbons from the earth involve operations for fracturing rock formations. Hydraulic fracturing may involve operations for perforating a casing or lining of a wellbore. Typically, perforating and fracturing are operated in stages. At each stage, a perforating gun may move to a pre-designed position and perforate a cluster of holes on the wall of casing. After the perforating tool is removed from the well head, the borehole may be sealed by a plug below the newly perforated holes, and fracturing mud may be injected into the borehole by surface pumps to produce fracturing in the formation nearby the perforated holes. After fracturing, the pump may be stopped and borehole pressure released. The perforating tool may again be inserted into the wellbore to create another perforating cluster above the previous cluster, and another next stage begins. During mud injection and fracturing, the pressure in the borehole above the plug may increase several thousands of pounds per square inch (psi) to yield sufficient pressure for formation fracturing, while the pressure below the plug may be close to the formation pressure, as the well segment below the plug may be connected to the formation through perforated holes of previous stages. The large pressure difference above and below the plug may push the plug moving downwards during mud injection.

During hydraulic fracturing ("fracking"), plug movement may occur in the subsurface with high pressure in a borehole. It may be challenging and unsafe to use subsurface sensors to directly monitor the plug movement. Pump operations and dynamic pressure may be monitored at the well head. However, both fracture opening and plug movement may produce additional fluid channels and yield similar pressure drop events. Hence, it may be challenging to identify the plug movement from normal fracture opening based on surface pressure information.

Identifying movement of plugs may help field engineers understand the subsurface status and adjust perforating and fracturing plan to meet the pre-designed performance.

BRIEF DESCRIPTION OF THE DRAWINGS

Implementations of the disclosure may be better understood by referencing the accompanying drawings.

after a stage of hydraulic fracturing and is a graph 500 showing fracking stages in the feature space with both low well bottom impedance and low drilling torque as the fracking stages with plug movement.

Figure 6:
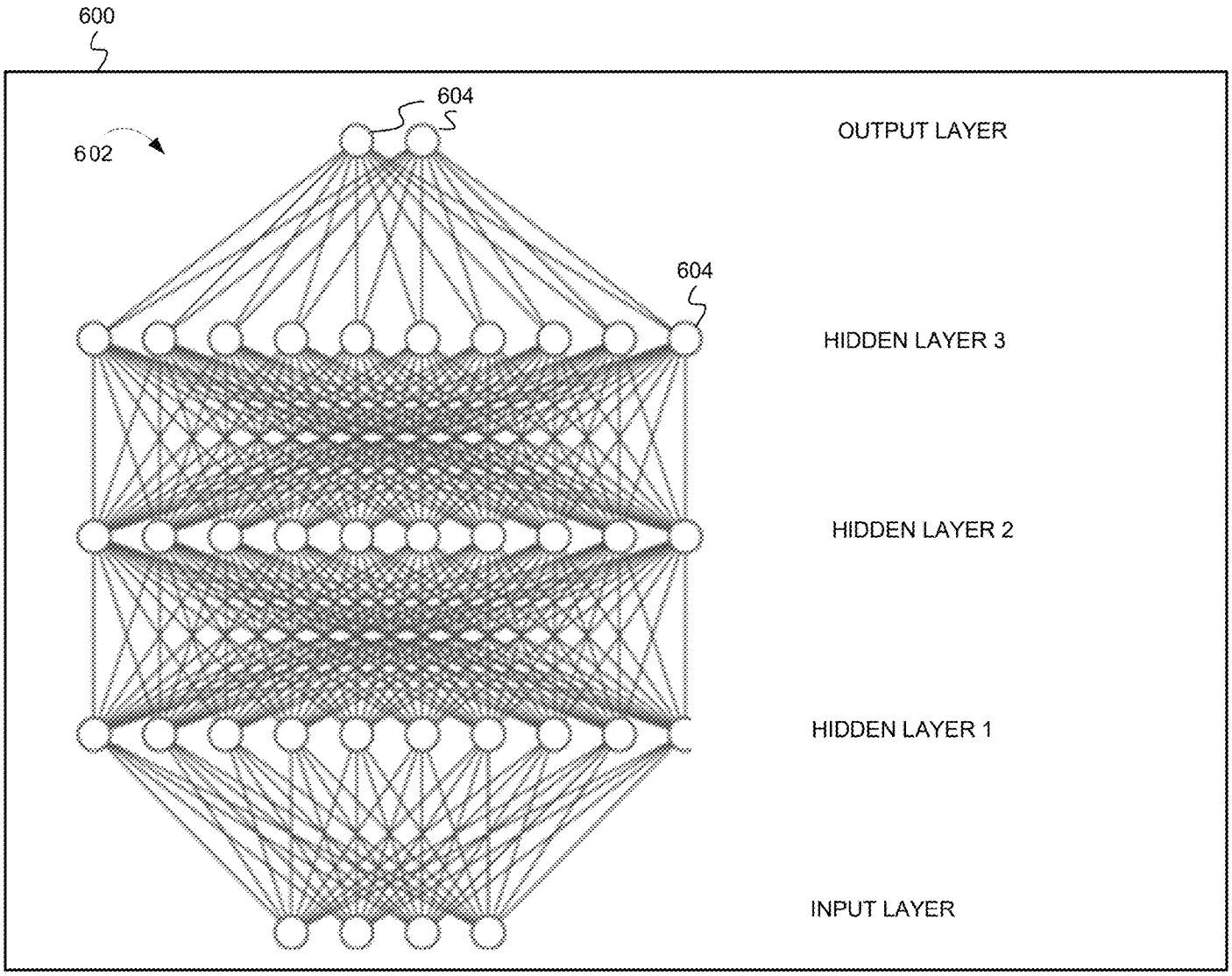

FIG. 6 is diagram illustrating an example ANN included in some implementations.

Figure 7:
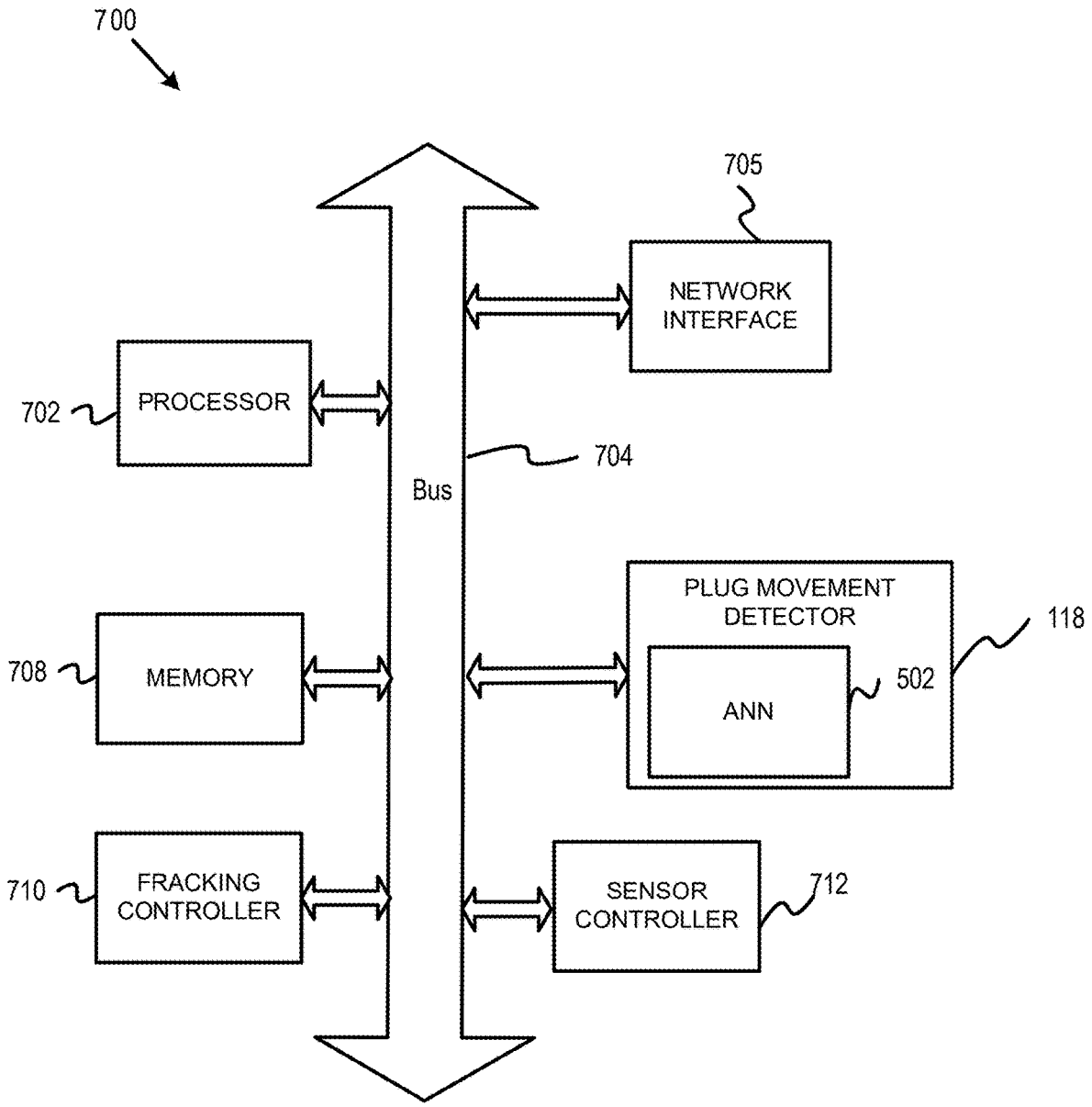

FIG. 7 is a block diagram illustrating a computer system that may be utilized with some implementations.

Figure 8:
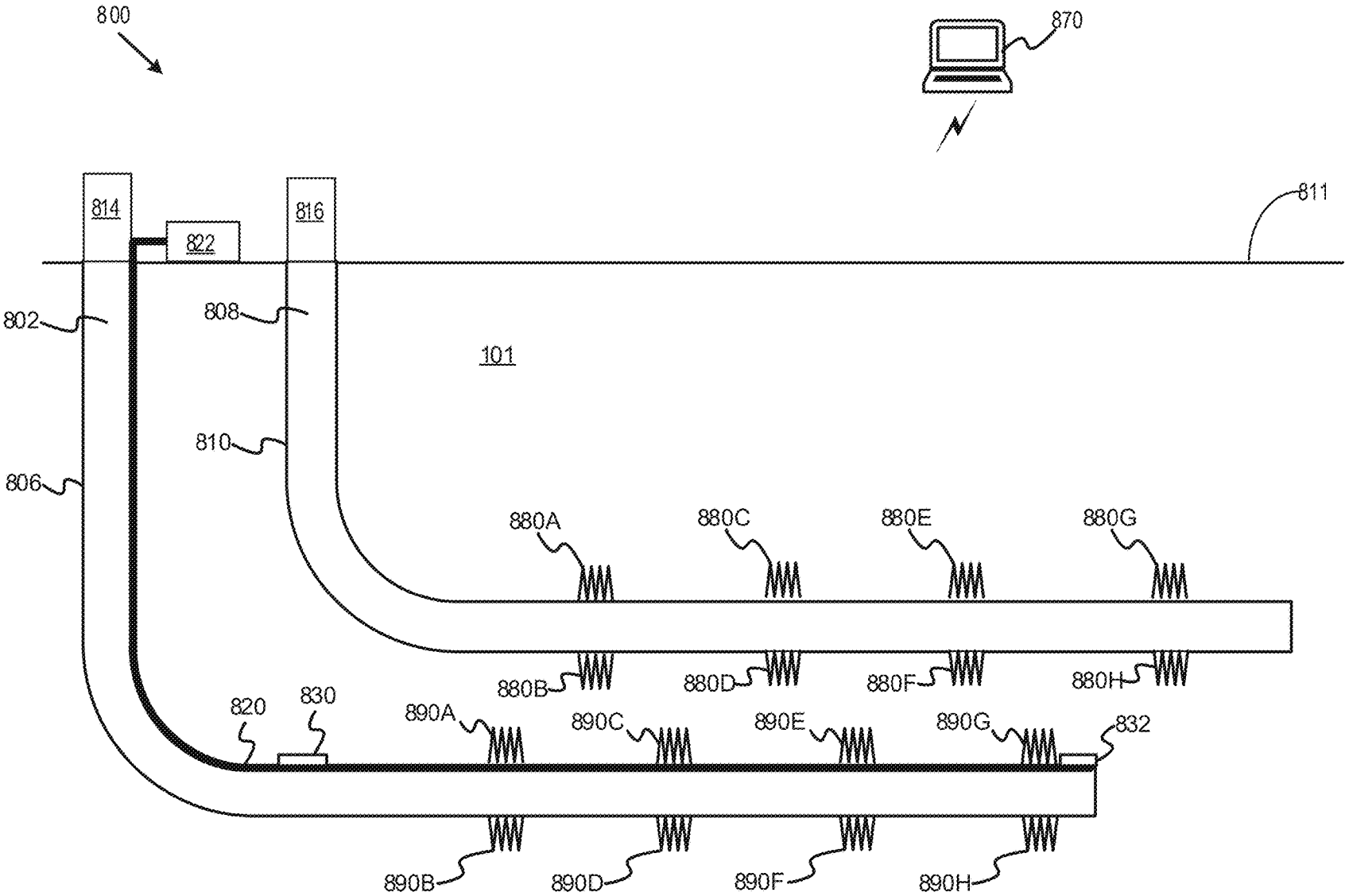

FIG. 8 is an illustration depicting an example multi-well system, according to some implementations.

Figure 9:
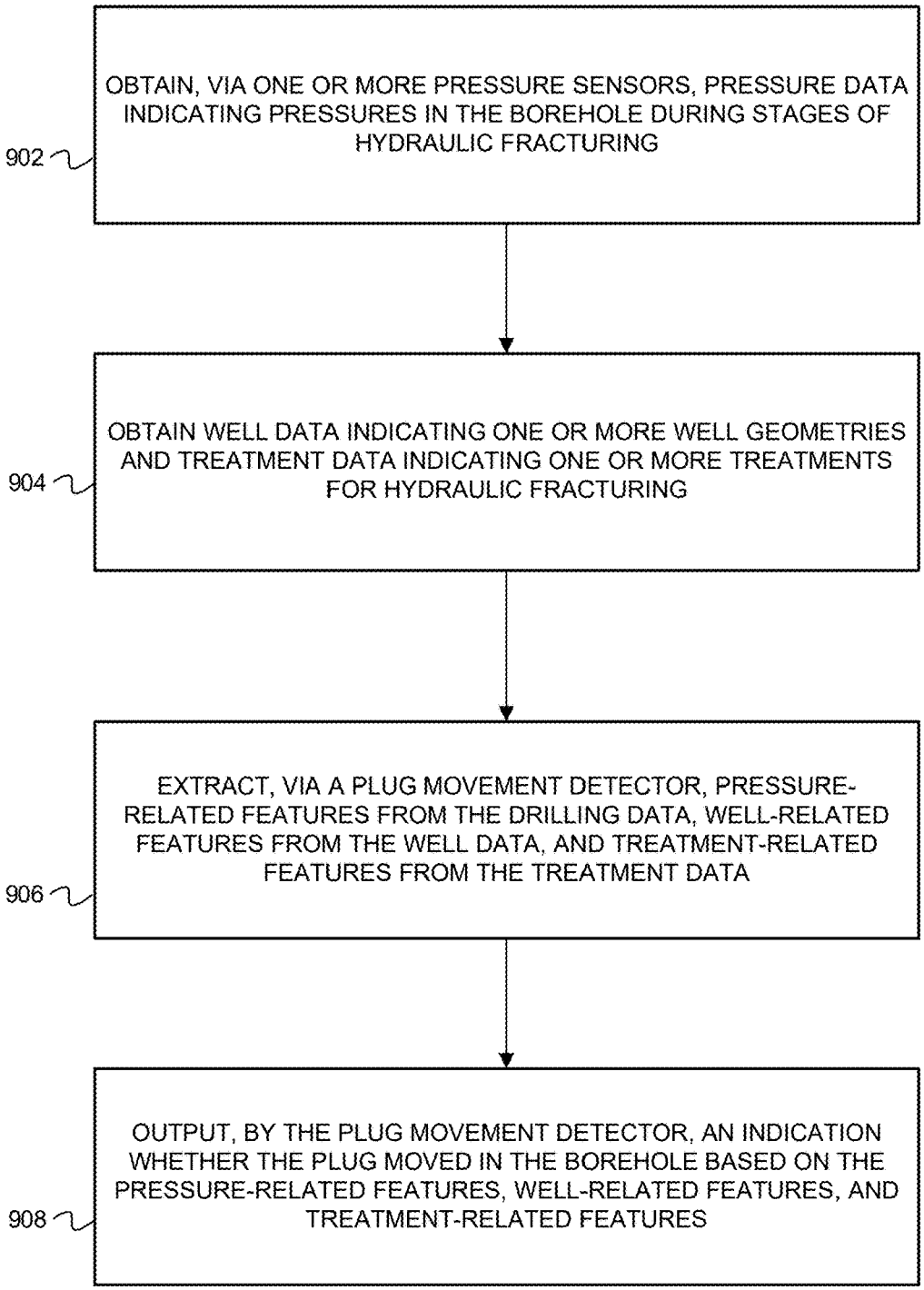

FIG. 9 is a flow diagram showing operations for identifying movement of a plug in a borehole of a well.

DESCRIPTION OF IMPLEMENTATIONS

The description that follows may include example systems, methods, techniques, and program flows that embody implementations of the disclosure. However, this disclosure may be practiced without these specific details. For clarity, some well-known instruction instances, protocols, structures, and techniques may not be shown in detail.

Overview

Operations for hydrocarbon recovery include drilling, casing and cementing. After casing and cementing, operations for perforating and fracturing progress in stages. During perforating, perforations may be made at pre-designed positions at each stage and a plug is set below the perforations. Next, fracturing mud (mixtures may include water, stimulation fluids and sands) may be pumped into the borehole to produce fractures in formations near the perforations. The plug is expected to fully seal the borehole during fracturing. However, as fracturing pressure (above the plug) may be much higher than the formation pressure (below the plug), the pressure may push the plug to move down during the fracturing.

Some implementations enable field engineers to identify plug movement and understand the subsurface status of a well and adjust perforating and fracturing plans to meet pre-designed performance. Some implementations use a statistical classification method to predict plug movement based, at least in part, on pressure data (such as pressure readings at a wellhead). Some implementations may predict drill bit torque that may be needed during plug drill-out based, at least in part, on the pressure data. Some implementations may implement the statistical classification method via a plug movement detector that performs operations to determine whether a plug has moved.

Some implementations may train the plug movement detector using a training data set created from the pressure data and drilling data. The pressure data may indicate pressure measurements taken at a wellhead during hydraulic fracturing. The drilling data may be collected during a plug drill-out stage (after a stage of hydraulic fracturing). The drilling data may indicate torque on the drill bit during plug drill-out and whether the plug moved or did not move. Hence, drilling data related to plug movement may be used to label the pressure data in the training data set. The drilling data related to plug movement also may be used to label the pressure data indicating toque on the drill bit during plug drill-out.

After training the plug movement detector, the trained plug movement detector may be configured to predict (during fracturing) whether a plug has moved based on pressure data—without any other information. Additionally, the plug movement detector may predict torque needed to drill-out the plug based on the pressure data. These and other aspects are described in more detail below.

Example Implementations

As noted, some implementations train a plug movement detector based on pressure data and drilling data. After the plug movement detector is trained, it may predict whether a plug has moved based various data (described in more detail below). Some implementations may respond to predictions of plug movement by taking responsive measures. For example, if the prediction is made during fracking, the system may stop pumping and move to the next stage, add a diverter, modify sand concentration, adjust treatments such that fluid goes to the desirable perforations, or take other suitable remedial actions.

The discussion will proceed with aspects of training the plug movement detector.

Figure 1:
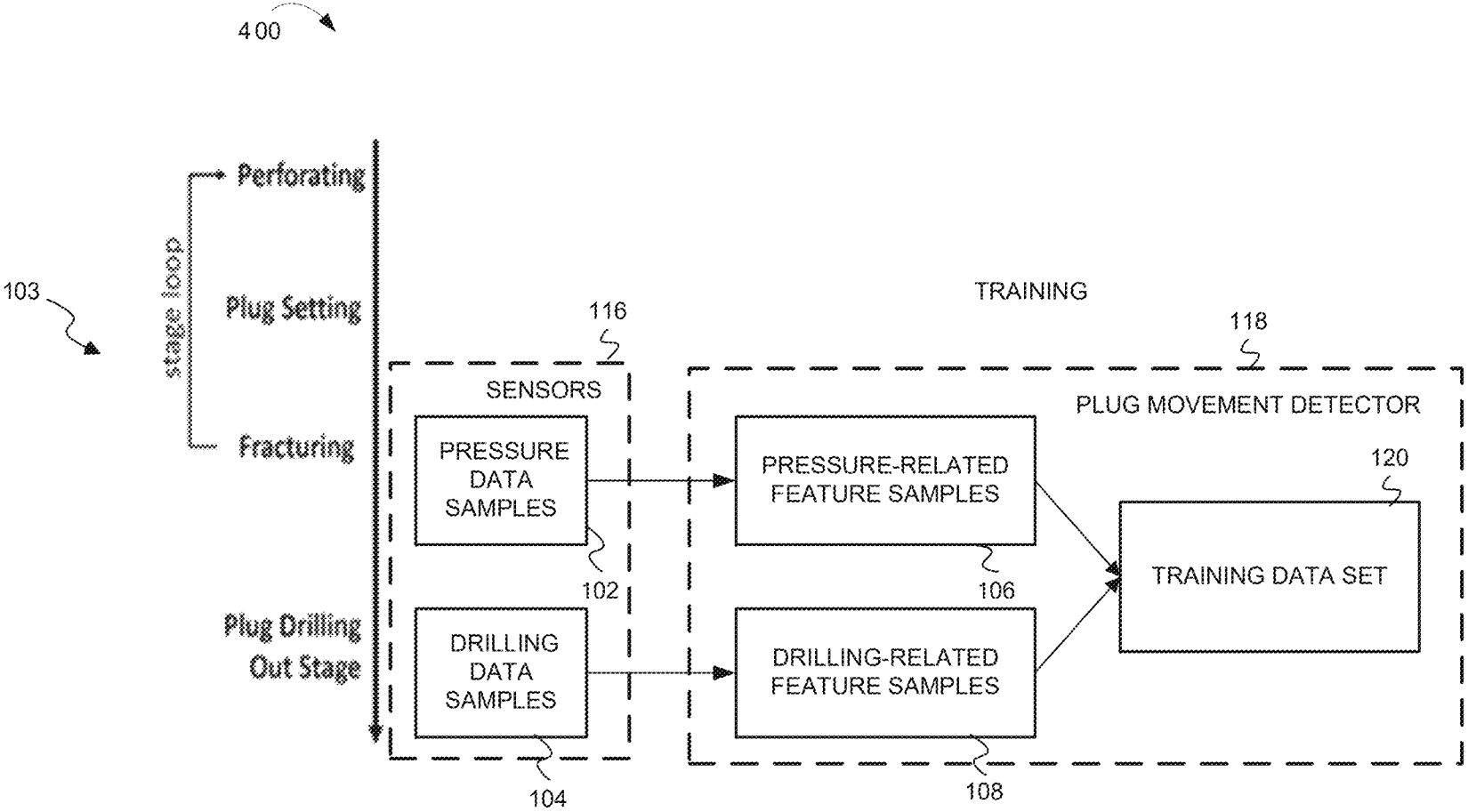
FIG. 1 is a diagram showing example operations for training the plug movement detector.

FIG. 1 is a diagram showing example operations for training the plug movement detector. In FIG. 1, the diagram 100 shows (left) fracking operations 103 including perforating, plug setting, fracturing, and plug drill-out. The operations of perforating, plug setting, and fracturing constitute a loop that may be repeated any suitable number of times during a stage. After one or more iterations of the loop, the plug drill-out may be performed after fracking stage has ended.

Figure 2:
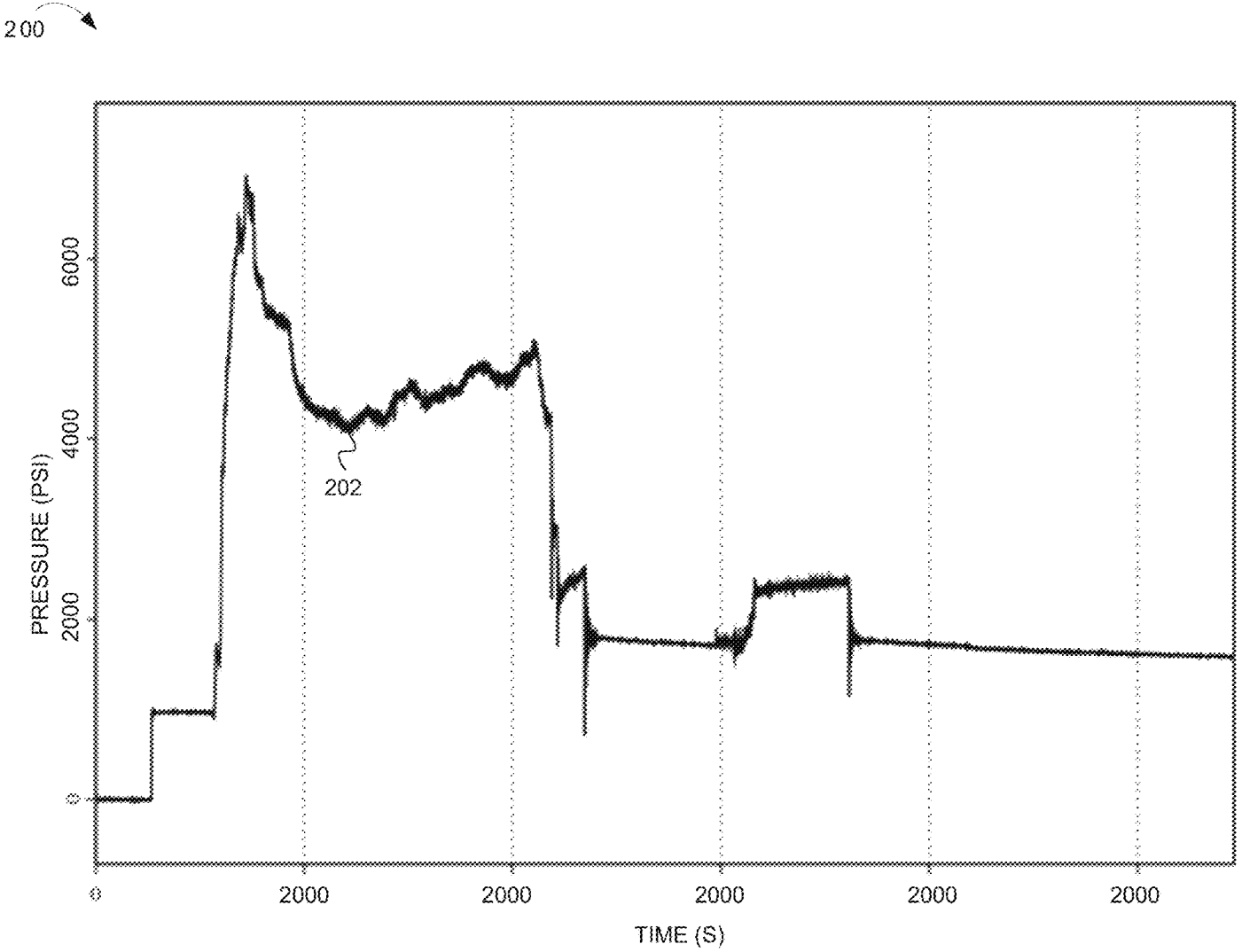
FIG. 2 is a graph illustrating example pressure data.

Some implementations collect sample data for the training data set 120 during fracturing and at the plug drill-out stage. During fracturing, sensors 116 (such as one or more hydrophones at the wellhead) may capture pressure data samples 102 during the fracturing stage. The pressure data samples 102 may include data captured by a hydrophone at the well head during fracturing at each stage. FIG. 2 is a graph illustrating example pressure data. In some implementations, the sensors 116 capture the pressure values shown in the graph 200. The graph 200 includes a plot 202 indicating pressure over a time period during a fracturing stage, where the pump starts at about 1000 seconds(s) and ends about 4500 s. At commencement of fracking, a high hydraulic impedance is present and leads to a high borehole pressure. The pressure drops from 1200 s to 2100 s as more fractures are produced in the formation through the perforations. There could be plug movement during the fracturing, but it may yield a pressure drop similar to the fracture opening.

Figure 3:
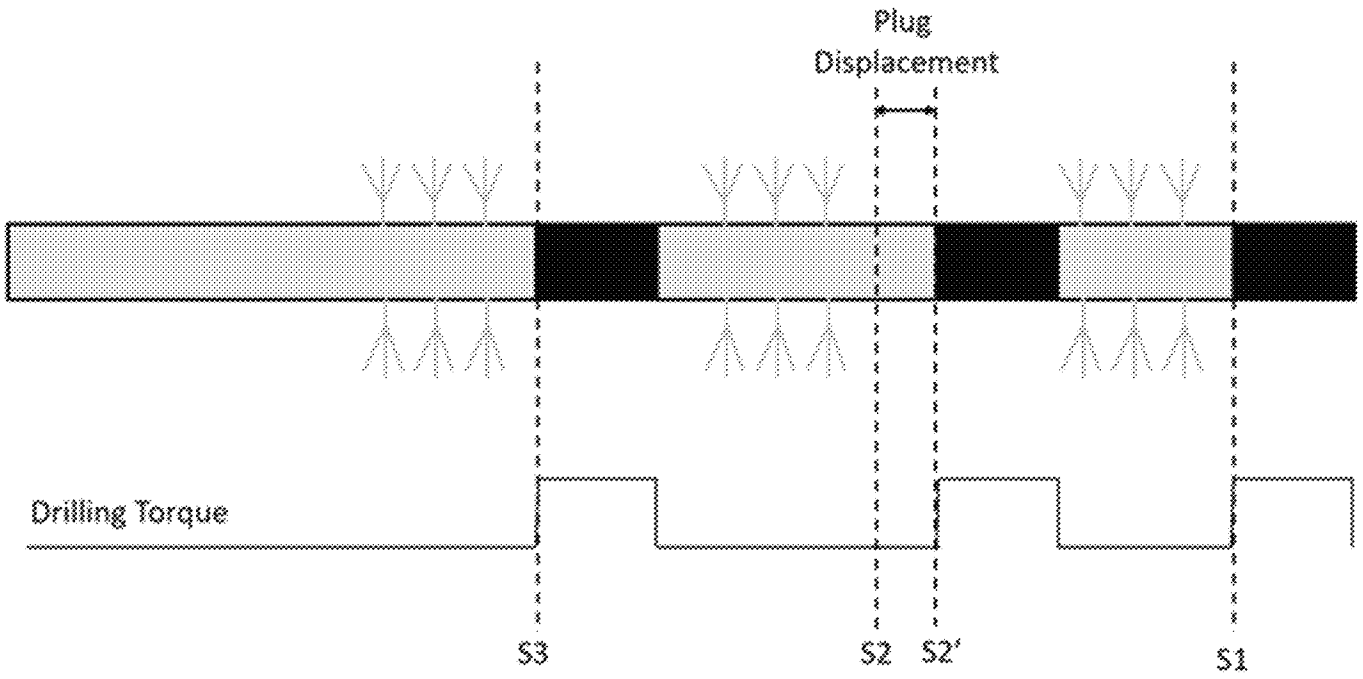
FIG. 3 is a diagram showing an example of torque on the drill bit in the plug drill-out stage.

During the plug drill-out stage, some implementations may collect drilling data samples 104 for the training data set 120. The drilling data samples 104 may indicate or otherwise related to drilling torque samples, drilling tension samples, and drag force samples recorded by the sensors 116 (such as sensors on the drill bit). FIG. 3 is a diagram showing an example of torque on the drill bit in the plug drill-out stage. For stages in which the plug does not move, such as S1 and S3, a higher drilling torque may be needed at the predesigned location of the related plugs. However, when the plug moved from the pre-designed location S2 to an actual location S2', the drilling torque rises at the actual location S2' instead of pre-designed location S2. The drilling data may indicate location, which may directly indicate the actual plug location. Additionally, the drilling torque, tension, or drag force may depend not only on the plug but also on the status of drilling fluids and drilling bits. The drilling data samples may include data about the drilling fluids, drilling bits, well geometries, and other aspects of the well and fracturing stages.

The plug movement detector 118 may extract pressure-related features 106 from the pressure data samples and add them to the training data set 120. The pressure data samples may be time sequences and may depend on the well bottom fractures and plug locations. The pressure data samples also may depend on the fluid properties in the borehole and the wellhead pumping operations. To identify subsurface plug movement more effectively, some implementations extract some well bottom features for each stage instead of using only measurements of well head pressure. The pressure-related feature samples may indicate the hydraulic impedance (R), inductance (L) and capacitance (C) at the well bottom. Some implementations may perform inversion on the pressure data to estimate the well bottom features samples. These inverted features may relate only to the plug location and fracturing opening of each stage and may be independent to borehole fluids and well head operations.

The plug movement detector 118 may extract drilling-related features 106 from the drilling data samples and add them to the training data set 120. The drilling-related features may indicate drilling torque, tension and drag force on the drill bit. In the training data set 120, the drilling-related features also may indicate locations at which the drill bit contacts the plug and/or other information about the location of the plug in the well.

At this point, the training data set 120 may include pressure-related features and drilling-related features. In some implementations, drilling-related features may be used to label the training data set 120. For example, a drilling-related feature may indicate drill bit measurements during plug drill-out (torque, tension, drag, etc.) and that the plug did not move in a particular stage. The pressure-related readings may include wellbore pressure readings for that stage, and those wellbore pressure readings may be labeled as being associated with a plug that did not move. The drilling-related features also may be used to label groups of features. For example, a drilling-related feature that indicates the plug did not move may be used to label pressure measurements and drill bit measurements to indicate those pressure and torque measurements are associated a drill bit that did not move.

Using the training data set 120, the plug movement detector 118 may perform training. After training, the plug movement detector 118 may be configured to predict whether a plug has moved based on pressure data without any location information (such as from the drilling data). The trained plug movement detector 118 also may predict torque for removing a plug during the plug drill-out stage.

Figure 4:
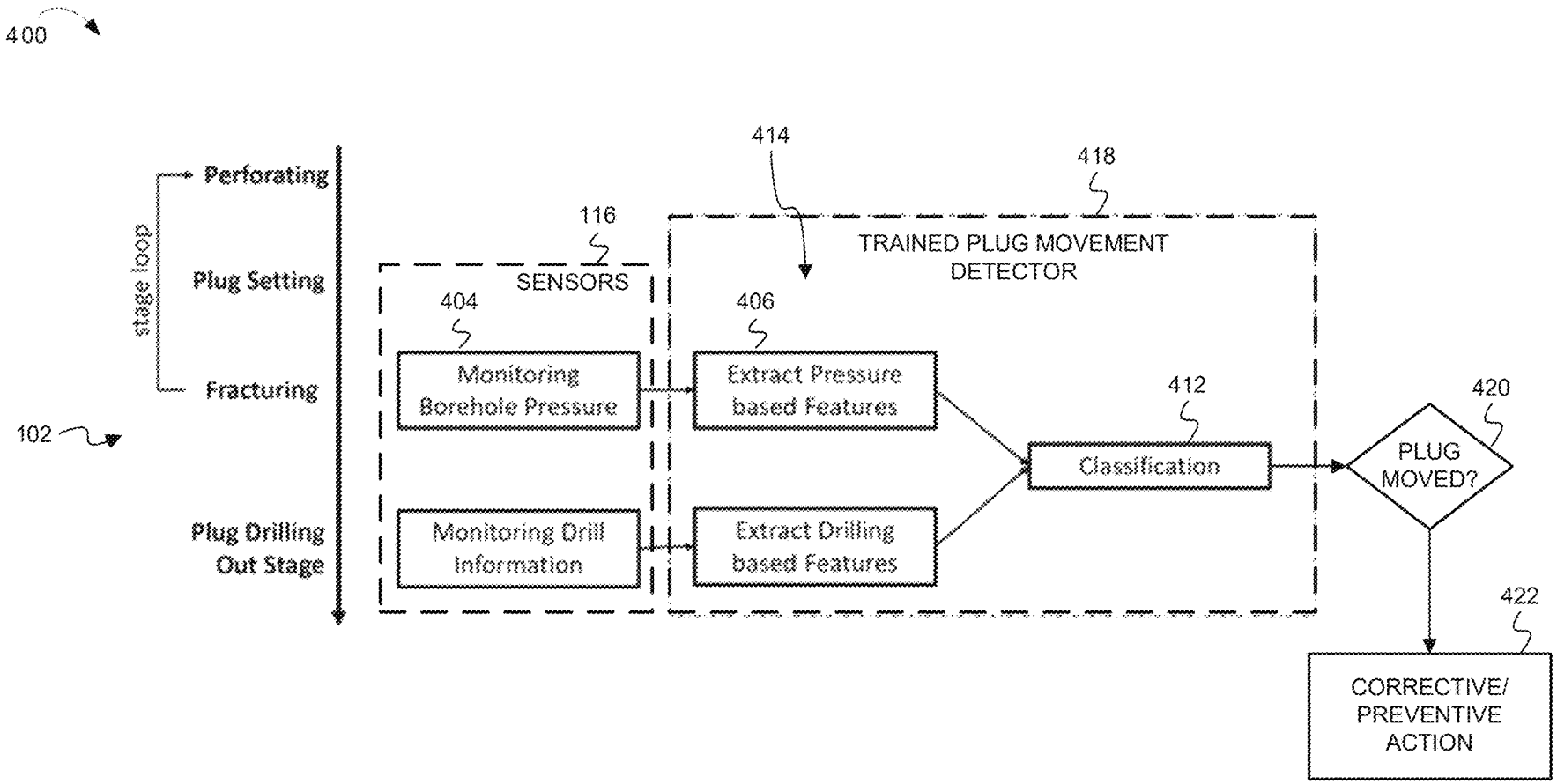
FIG. 4 is a diagram showing operations for using the trained plug movement detector to predict plug movement during fracking operations.

FIG. 4 is a diagram showing operations for using the trained plug movement detector to predict plug movement during fracking operations. In some implementations, the trained plug detector 418 may perform these operations continuously, periodically, on-demand, or per any other suitable operational schedule. In FIG. 4, the diagram 400 shows (left) fracking operations 102 including perforating, plug setting, fracturing, and plug drill-out. The operations of perforating, plug setting, and fracturing form a loop that may be repeated any suitable number of times during a stage. After one or more iterations of the loop, the plug drill-out may be performed after fracking stage has ended.

The diagram 400 also shows an operational path 414 path for identifying plug movement using the trained plug movement detector 418. The path 414 progresses from left to right.

The operational path 414 may be used during fracturing stages to make predictions about plug movement. At block 404, the sensors 116 (such as one or more hydrophones at the wellhead) may capture pressure data during the fracturing stage and transmit the pressure data to a trained plug movement detector 418.

At block 406, the trained plug movement detector 418 may extract pressure-related features from the pressure data. For example, the pressure-related features may indicate one or more borehole pressure measurements. The pressure-related features also may indicate one or more estimations of hydraulic inductance, impedance, and/or capacitance. Additionally, the trained plug movement detector 418 may obtain well data indicating one or more well geometries (such as tubular geometries, perforation geometries, and any other suitable geometric information about aspects of the well). The trained plug movement detector 418 also may obtain treatment data indicating aspects of the treatment being applied during the current stage. For example, the treatment data may indicate well configurations (structure and layout of the well), injection rates, pump schedules, rock strengths, proppants, chemicals, and any other suitable aspect of treatments. The trained plug movement detector 418 may extract well-related features from the well data and treatment-related features from the treatment data.

At block 412, the trained plug movement detector 418 may predict whether a plug has moved based, at least in part, on the pressure-related features. For example, the trained plug movement detector 418 may predict that a plug has moved based on pressure measurements at the wellhead. Notably, in some implementations, the trained plug movement detector 418 does not need location data to make this prediction. Additionally, the trained plug movement detector 418 may predict a drill bit torque (or other drill bit measurement) that may be required to remove the plug during the future drill-out phase. In some implementations, the trained plug movement detector 418 may utilize the well-related features and/or the treatment-related features when making this prediction. The operational path 410 may be repeated any number of times during a fracturing stage. If the plug moved (block 420), corrective or preventive action may be taken (discussed below).

Corrective or preventive actions (block 420) may include directing changes to one or more aspects of the stage loop and/or plug drill-out stages. Hence, one or more attributes may change in the wellbore in response to predictions made by the trained plug movement detector 418. For example, in response to the trained plug movement detector 418 predicting a plug has moved, a controller (such as fracking controller 710 of FIG. 7) may perform (and/or direct to be performed) a change to a downhole operation or attribute. The downhole operation or attribute may be part of a hydraulic fracturing treatment or other fracking operation. For example, physical attributes in a borehole may be set based on predictions made by the trained plug movement detector 418. Examples of such attributes may include depth, composition of the proppant used for fracking, composition of the fracking fluid used for fracking, the pump rate for fracking, etc. In some embodiments, the controller may alter (or cause to be altered) one or more attributes in the borehole. As a result, in response to predictions made by the trained plug movement detector 418, there may be modification of depth, composition of the proppant used for fracking, composition of the fracking fluid used for fracking, the pump rate for fracking, and/or other suitable attributes in the wellbore.

As noted, the plug movement detector 118 (and trained plug movement detector 418) may include a statistical classifier. The statistical classifier may be a supervised classifier such as an artificial neural networks (ANN), self-organized mapping (SOM), supported vector machines (SVM), or other suitable mechanism. In some implementations, the statistical model may be trained with labeled data (see discussion of training). In some implementations, the statistical classifier may be trained via non-supervised training, where the statistical classifier may utilize clustering methods based on the high-dimensional feature space.

Figure 5:
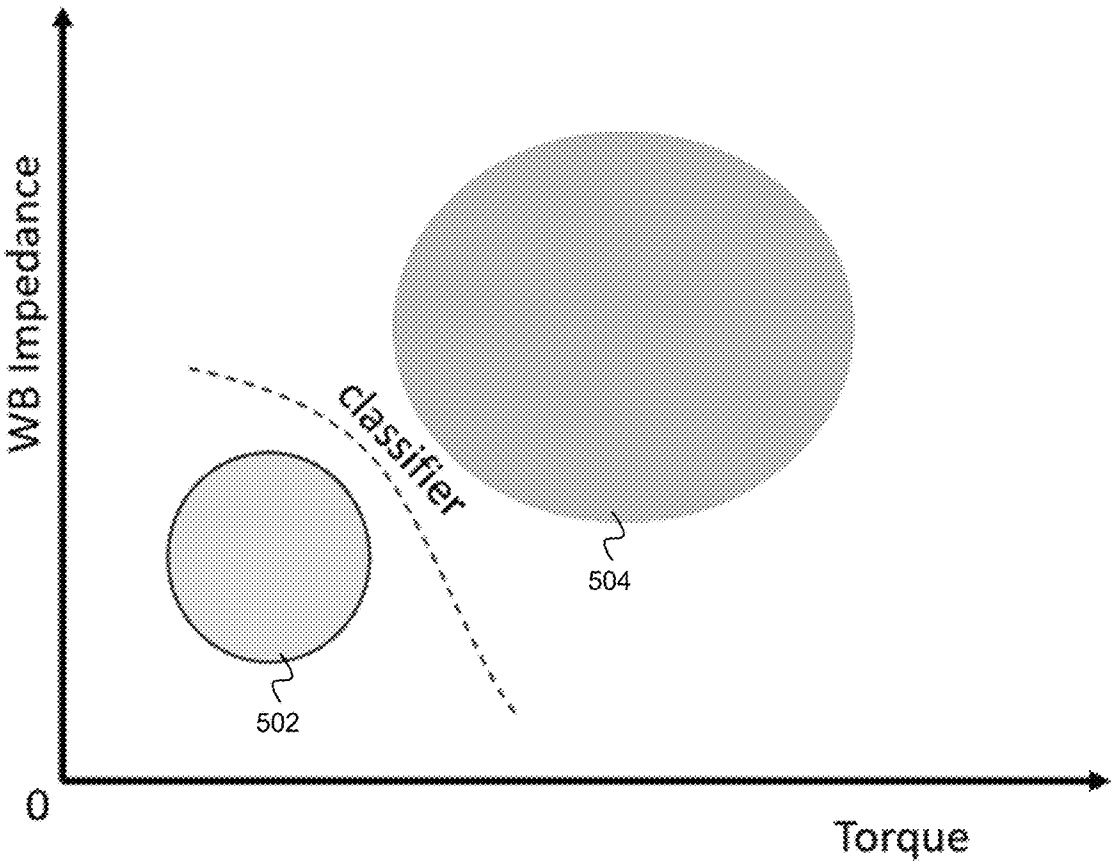

Some implementations may combine the pressure-related features and drilling-related features to predict subsurface plug movement. These implementations may reliably avoid inaccurate predictions related to normal fracture opening events in a complicated drilling environment. As an example, FIG. 5 shows how the well bottom impedance and drilling torque features in a high dimensional feature space may help the statistical classifier. FIG. 5 is a graph 500 showing fracking stages in the feature space with both low well bottom impedance and low drilling torque as the fracking stages with plug movement. An area 502 represents fracking stages with plug movement, whereas an area 504 represents fracking stages without plug movement.

As noted, in some implementations, the plug movement detector may include an artificial neural network (ANN). FIG. 6 is diagram illustrating an example ANN included in some implementations. In FIG. 6, the plug movement detector includes the ANN 602. The ANN 602 may include a plurality of neurons 604. The ANN 602 also may include an input layer having any suitable number of neurons 604 (supporting any suitable number of features). The input layer may intake information (sometimes referred to as features) indicating a current resistance, the designed target resistance for the fracture treatment, and the current factor vector. The ANN 602 also may include an output layer that predicts plug movement based, at least in part, on pressure-related features (as described herein). The output layer may include any suitable number of neurons.

In some implementations, the plug movement detector may be integrated into a computer system. FIG. 7 is a block diagram illustrating a computer system that may be utilized with some implementations. In FIG. 7, the computer system 700 may include one or more processors 702 connected to a system bus 704. The system bus 704 may be connected to memory 708 and a network interface 705. The memory 708 may include any suitable memory random access memory (RAM), non-volatile memory (e.g., magnetic memory device), and/or any device for storing information and instructions executable by the processor(s) 702. The network interface 705 may provide connectivity to any suitable network, such as a wired network, wireless network, satellite network, etc.

The computer system 700 may include additional peripheral devices. For example, the computer system 700 may include multiple external multiple processors. In some implementations, any of the components may be integrated or subdivided.

The computer system 700 also may include a plug movement detector 118. The plug movement detector 118 may implement the methods and operations described herein. The plug movement detector 118 may include an ANN 502 or other logic for performing machine learning and classification operations described herein. In some implementations, the computer system 700 may be included in the well system (such as the well system described with reference to FIG. 7 and may cooperate with other components and/or systems to perform the functionality described herein.

The computer system 700 also may include a sensor controller 712 configured to perform operations for capturing sensor data (such as pressure sensor readings, torque sensor readings, etc.) and processing the sensor data. The sensor controller 712 may transmit pressure data and drilling data to the plug movement detector 118 or any other component in or external to the computer system 700.

The computer system 700 also may include a fracking controller 710 configured to perform operations for controlling hydraulic fracturing in a well. The fracking controller 710 may respond to output (such as classifications) from the plug movement detector 118. For example, the fracking controller 710 may alter at least one aspect of a fracking stage in response to a prediction (or classification) generated by the plug movement detector 118.

Although the components are shown separately, any of the components of the computer system 700 may be further combined or subdivided. For example, the factor vector unit 706 and fracking controller 710 may be combined into a single component or subdivided into three or more components. Any component of the computer system 700 may be implemented as hardware, firmware, and/or machine-readable media including computer-executable instructions for performing the operations described herein. For example, some implementations include one or more non-transitory machine-readable media including computer-executable instructions including program code configured to perform functionality described herein. Machine-readable media includes any mechanism that provides (e.g., stores and/or transmits) information in a form readable by a machine (e.g., a computer system). For example, tangible machine-readable media includes read only memory (ROM), random access memory (RAM), magnetic disk storage media, optical storage media, flash memory machines, etc. Machine-readable media also includes any media suitable for transmitting software over a network.

Example Environment

The computer system 700 may be part of a larger system for drilling and fracturing well. FIG. 8 is an illustration depicting an example multi-well system, according to some implementations. In particular, FIG. 8 is a schematic of a multi-well system 800 that includes a wellbore 802 and a wellbore 808 in a subsurface formation 801. The wellbore 802 includes casing 806 and a number of perforations 890A-890H being made in the casing 806 at different depths to allow reservoir fluids (i.e., oil, water, and gas) from the subsurface formation 801 to flow into the wellbore 802. Similarly, the wellbore 808 includes casing 810 and a number of perforations 880A-880H being made in the casing 810 to allow reservoir fluids (i.e., oil, water, and gas) from the subsurface formation 801 to flow into the wellbore 808. During hydraulic fracturing operations of the wellbores 802 808, fracturing fluid, with or without sand, may be pumped into the subsurface formation 801, via the perforations 890A-890H and perforations 880A-880H, to hydraulically fracture the rock such that reservoir fluid may flow into the wellbore 802, 808, respectfully.

In some implementations, one or more sensors may be positioned in a wellbore to obtain measurements while an offset well is being hydraulically fractured. For example, the wellbore 802 may include a fiber optic cable 820 to obtain strain measurements, temperature measurements, derived pressure measurements (from strain measurements), etc. of the subsurface formation 801 while the wellbore 808 is being hydraulically fractured. The fiber optic cable 820 may extend from the wellhead 814 on the surface 811 to the subsurface along the wellbore 802. The fiber optic cable 820 may be cemented in place in the annular space between the casing 806 of the wellbores 802 and the subsurface formation 801. The fiber optic cable 820 may be clamped to the outside of the casing 806 during deployment and protected by centralizers and cross coupling clamps. The fiber optic cables 820 may be included with coiled tubing, wireline, loose fiber using coiled tubing, or gravity deployed fiber coils that unwind the fiber as the coils are moved in the wellbore 802. The fiber optic cable 820 also may be deployed with pumped down coils and/or self-propelled containers. Additional deployment options for the fiber optic cable 820 may include coil tubing and wireline deployed coils where the fiber optic cables 820 are anchored at the toe of the wellbore. In such implementations the fiber optic cable 820 may be deployed when the wireline or coiled tubing is removed from the well. The fiber optic cable 820 may house one or more optical fibers, and the optical fibers may be single mode fibers, multi-mode fibers, or a combination of single mode and multi-mode optical fibers. The distribution of sensors shown in FIG. 8 is for example purposes only. Any suitable sensor deployment may be used.

The fiber optic cable 820 may be used for distributed sensing where acoustic, vibration, strain, and temperature measurements may be collected downhole in the wellbores 802. The measurements may be collected at various positions distributed along the fiber optic cable 820. For example, data may be collected every 1-3 ft along the full length of the fiber optic cable 820 downhole along the horizontal section of the wellbore. Fiber optic interrogation unit 822 of the wellbore 802 may be located on the surface 811 of the multi-well system 800. The fiber optic interrogation units 822 may be directly coupled to the fiber optic cables 820. Alternatively, the fiber optic interrogation units 822 may be coupled to a fiber stretcher module, wherein the fiber stretcher module is coupled to the fiber optic cable 820. The fiber optic interrogation unit 822 may receive measurement values taken and/or transmitted along the length of the fiber optic cable 820 such as acoustic, temperature, strain, etc. The fiber optic interrogation unit 822 may be electrically connected to a digitizer to convert optically transmitted measurements into digitized measurements.

The fiber optic interrogation unit 822 may operate using various sensing principles including but not limited to amplitude-based sensing systems like DTS, DAS, Low Frequency Distributed Acoustic Sensing (LFDAS), Distributed Vibration Sensing (DVS), and Distributed Strain Sensing (DSS). For example, the DTS system may be based on Raman and/or Brillouin scattering. A DAS system may be a phase sensing-based system based on interferometric sensing using homodyne or heterodyne techniques where the system may sense phase or intensity changes due to constructive or destructive interference. The DAS system may also be based on Rayleigh scattering and in particular coherent Rayleigh scattering. A DSS system may be a strain sensing system using dynamic strain measurements based on interferometric sensors or static strain sensing measurements using Brillouin scattering. DAS systems based on Rayleigh scattering may also be used to detect dynamic strain events. Temperature effects may in some cases be subtracted from both static and/or dynamic strain events, and temperature profiles may be measured using Raman based systems and/or Brillouin based systems capable of differentiating between strain and temperature, and/or any other optical and/or electronic temperature sensors, and/or any other optical and/or electronic temperature sensors, and/or estimated thermal events.

In some implementations, the fiber optic interrogation unit 822 may measure changes in optical fiber properties between two points in an optical fiber at any given point, and these two measurement points move along the optical sensing fiber as light travels along the optical fiber. Changes in optical properties may be induced by strain, vibration, acoustic signals and/or temperature as a result of the fluid flow. Phase and intensity based interferometric sensing systems are sensitive to temperature and mechanical, as well as acoustically induced, vibrations. DAS data may be converted from time series data to frequency domain data using Fast Fourier Transforms (FFT) and other transforms, like wavelet transforms, also may be used to generate different representations of the data. Various frequency ranges may be used for different purposes and low frequency signal changes may be attributed to formation strain changes or fluid movement and other frequency ranges may be indicative of fluid movement. Various techniques may be applied to generate indicators of events related to the generation and/or expansion of shear induced fracture fields during hydraulic fracturing operations. Although FIG. 8 depicts the fiber optic cable 820 in the wellbore 802, a fiber optic cable 820 may also be positioned in the wellbore 808 to obtain measurements when the wellbore 802 is hydraulically fractured.

The wellbore 802 may also include pressure sensors, such as externally ported pressure sensors 830, 832, to measure the formation pressure while the offset wellbore 808 is hydraulically fractured. Although FIG. 8 depicts the externally ported pressure sensors 830, 832 at the heel and toe of the wellbore 802, respectively, the externally ported pressure sensors 830, 832 may be positioned at any suitable location in the wellbore 802. Although FIG. 8 depicts the externally ported pressure sensors 830, 832 external to the casing 806 of the wellbore 802, externally ported pressure sensors 830, 832 may also be positioned in the wellbore 808 to obtain measurements when the wellbore 802 is hydraulically fractured.

During the hydraulic fracturing operations of wellbore 802 and/or wellbore 808, shear induced fracturing fields may be generated and/or dilated. For example, the shear induced fracturing fields comprising Mode 2 and/or Mode 3 failures may form between clusters of a stage, between stages of a wellbore, between clusters and/or stages of offset wellbores, etc. In some implementations, the fiber optic cable 820 and/or the externally ported pressure sensors 830, 832 may obtain measurements of the subsurface formation 801 to detect and/or monitor the subsurface formation 801 and the shear induced fracture fields.

A computer 870 may be communicatively coupled to the fiber optic interrogation units 822, externally ported pressure sensors 830, 832, and other sensors in the multi-well system 800. The computer 880 may include a signal processor to perform various signal processing operations on signals captured by the fiber optic interrogation units 822, externally ported pressure sensors 830, 832, and/or other components of the multi-well system 800. The computer 870 may have one or more processors and a memory device to analyze the measurements and graphically represent analysis results on a display device. The computer 870 may include one or more of the components described with reference to FIG. 6. The computer 870 may be configured to identify plug movement during stages of hydraulic fracturing (as described herein). Although FIG. 8 depicts a system with multiple wellbores, embodiments described herein may also be applicable to other systems such as a single well system, multiple pads, etc.

FIG. 9 is a flow diagram showing operations for identifying movement of a plug in a borehole of a well. At block 902, a plug movement detector obtains, via one or more pressure sensors, pressure data indicating pressures in the borehole during stages of hydraulic fracturing. At block 904, a plug movement detector obtain well data indicating one or more well geometries and treatment data indicating one or more treatments for hydraulic fracturing. At block 906, the plug movement detector extracts pressure-related features from the drilling data, well-related features from the well data, and treatment-related features from the treatment data. At block 908, the plug movement detector outputs an indication whether the plug moved in the borehole based on the pressure-related features, well-related features, and treatment-related features.

FIGS. 1-9 and the operations described herein are examples meant to aid in understanding example implementations and should not be used to limit the potential implementations or limit the scope of the claims. None of the implementations described herein may be performed exclusively in the human mind nor exclusively using pencil and paper. None of the implementations described herein may be performed without computerized components such as those described herein. Some implementations may perform additional operations, fewer operations, operations in parallel or in a different order, and some operations differently. Some implementations may perform the operations with different components.

As used herein, a phrase referring to "at least one of"' a list of items refers to any combination of those items, including single members. As an example, "at least one of: a, b, or c" is intended to cover: a, b, c, a-b, a-c, b-c, and a-b-c.

The various illustrative logics, logical blocks, modules, circuits, and algorithm processes described in connection with the implementations disclosed herein may be implemented as electronic hardware, computer software, or combinations of both. The interchangeability of hardware and software has been described in terms of functionality, and illustrated in the various illustrative components, blocks, modules, circuits and processes described throughout. Whether such functionality is implemented in hardware or software depends upon the particular application and design constraints imposed on the overall system.

The hardware and data processing apparatus used to implement the various illustrative logics, logical blocks, modules and circuits described in connection with the implementations disclosed herein may be implemented or performed with a general purpose single- or multi-chip processor, a digital signal processor (DSP), an application-specific integrated circuit (ASIC), a field-programmable gate array (FPGA) or other programmable logic device, discrete gate or transistor logic, discrete hardware components, or any combination thereof designed to perform the functions described herein. A general-purpose processor may be a microprocessor or any conventional processor, controller, microcontroller, or state machine. A processor also may be implemented as a combination of computing devices, e.g., a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more implementations, the functions described may be implemented in hardware, digital electronic circuitry, computer software, firmware, including the structures disclosed in this specification and their structural equivalents thereof, or in any combination thereof. Implementations of the subject matter described in this specification also may be implemented as one or more computer programs, such as one or more modules of computer program instructions stored on a computer storage media for execution by, or to control the operation of, a computing device.

If implemented in software, the functions may be stored on or transmitted over as one or more instructions or code on a computer-readable medium. The processes of a method or algorithm disclosed herein may be implemented in a processor-executable instructions which may reside on a computer-readable medium. Computer-readable media includes both computer storage media and communication media including any medium that may be enabled to transfer a computer program from one place to another. Storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection may be properly termed a computer-readable medium. Disk and disc, as used herein, includes compact disc (CD), laser disc, optical disc, digital versatile disc (DVD), floppy disk, and Blu-Ray™ disc where disks usually reproduce data magnetically, while discs reproduce data optically with lasers. Combinations also may be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable subcombination. Moreover, although features may be described as acting in certain combinations and even initially claimed as such, one or more features from a claimed combination may in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel processing may be advantageous. Moreover, the separation of various system components in the implementations described should not be understood as requiring such separation in all implementations, and the described program components and systems may be integrated together in a single software product or packaged into multiple software products. Additionally, other implementations are within the scope of the following claims. In some cases, the actions recited in the claims may be performed in a different order and still achieve desirable results.

Some parts of this disclosure refer to the "trained plug movement detector" to clarify that the plug movement detector has completed training with the training data set. However, references to the "plug movement identifier" that do not include "trained" may nevertheless be referring to instances for which training is complete.

Example Clauses

Some implementations may include the following clauses.

Clause 1: A method for identifying movement of a plug in a borehole of a well, the method comprising: obtaining, via one or more pressure sensors, pressure data indicating pressures in the borehole during stages of hydraulic fracturing; obtaining well data indicating one or more well geometries and treatment data indicating one or more treatments for hydraulic fracturing; extracting, via a plug movement detector, pressure-related features from the pressure data, well-related features from the well data, and treatment-related features from the treatment data; and outputting, by the plug movement detector, an indication whether the plug moved in the borehole based on the pressure-related features, well-related features, and treatment-related features.

Clause 2: The method of clause 1 further comprising: outputting, by the plug movement detector, a prediction of torque that will be needed to remove the plug during a plug drill-out stage based on the pressure-related features, well-related features, and treatment-related features.

Clause 3: The method of any one or more of clauses 1-2, wherein the pressure-related features include values for one or more of a hydraulic impedance at a well bottom in the well, a hydraulic inductance at a well bottom in the well, and a hydraulic capacitance at a well bottom in the well.

Clause 4: The method of any one or more of clauses 1-3 further comprising: performing inversion on the pressure data to determine the hydraulic impedance at a well bottom in the well, the hydraulic inductance at a well bottom in the well, and the hydraulic capacitance at a well bottom in the well.

Clause 5: The method of any one or more of clauses 1-4, wherein at least one of the pressure sensors is located at a wellhead of the well.

Clause 6: The method of any one or more of clauses 1-5 further comprising: training the plug movement detector based on a training data set including pressure data samples indicating pressure measurements in the borehole from past stages of hydraulic fracturing, drilling data samples indicating drill bit measurements from past drill-out stages in the borehole, drilling data samples indicating that the plug moved or did not move in the borehole, well data samples indicating one or more well geometries of past stages of hydraulic fracturing, and treatment data samples indicating one or more treatments of past stages of hydraulic fracturing.

Clause 7: The method of any one or more of clauses 1-6 further comprising: extracting pressure-related feature samples from the pressure data samples; and labeling the pressure-related feature samples using the drilling data samples to indicate that the plug moved or did not move in the borehole.

Clause 8: The method of any one or more of clauses 1-7, further comprising: modifying an aspect of one of the stages of the hydraulic fracturing or of a plug drill-out stage based, at least in part, on the indication that the plug moved; and performing, in the borehole, the modified aspect of the at least one of the stages of hydraulic fracturing operations.

Clause 9: One or more computer-readable mediums including instructions that, when executed by at least one processor, identify movement of a plug in a borehole of a well, the instructions comprising: instructions to obtain, via one or more pressure sensors, pressure data indicating pressures in the borehole during stages of hydraulic fracturing; instructions to obtain well data indicating one or more well geometries and treatment data indicating one or more treatments for hydraulic fracturing; instructions to extract, via a plug movement detector, pressure-related features from the pressure data, well-related features from the well data, and treatment-related features from the treatment data; and instructions to output, by the plug movement detector, an indication whether the plug moved in the borehole based on the pressure-related features, well-related features, and treatment-related features.

Clause 10: The one or more machine-readable mediums of clause 9 further comprising: instruction to output, by the plug movement detector, a prediction of torque that will be needed to remove the plug during a plug drill-out stage based on the pressure-related features, well-related features, and treatment-related features.

Clause 11: The one or more machine-readable mediums of any one or more of clauses 9-10, wherein the pressure-related features include values for one or more of a hydraulic impedance at a well bottom in the well, a hydraulic inductance at a well bottom in the well, and a hydraulic capacitance at a well bottom in the well.

Clause 12: The one or more machine-readable mediums of any one or more of clauses 9-11 further comprising: instructions to perform inversion on the pressure data to determine the hydraulic impedance at a well bottom in the well, the hydraulic inductance at a well bottom in the well, and the hydraulic capacitance at a well bottom in the well.

Clause 13: The one or more machine-readable mediums of any one or more of clauses 9-12, wherein at least one of the pressure sensors is located at a wellhead of the well.

Clause 14: The one or more machine-readable mediums of any one or more of clauses 9-13, wherein at least one of the sensors is located at a wellhead of the well.

Clause 15: The one or more machine-readable mediums of any one or more of clauses 9-14 further comprising: instructions to train the plug movement detector based on a training data set including pressure data samples indicating pressure measurements in the borehole from past stages of hydraulic fracturing, drilling data samples indicating drill bit measurements from past drill-out stages in the borehole, drilling data samples the indicate that the plug moved or did not move in the wellbore, well data samples indicating one or more well geometries of past stages of hydraulic fracturing, and treatment data samples indicating one or more treatments of past stages of hydraulic fracturing.

Clause 16: The one or more machine-readable mediums of any one or more of clauses 9-15 further comprising: instructions to extract pressure-related feature samples from the pressure data samples; and instruction to label the pressure-related feature samples using the drilling data samples to indicate that the plug moved or did not move in the wellbore.

Clause 17: The one or more machine-readable mediums of any one or more of clauses 9-16 further comprising: instruction to modify an aspect of at least one of the stages of the hydraulic fracturing or the plug drill-out based, at least in part, on the indication that the plug moved; and instruction to perform, in the borehole, the modified aspect of the at least one of the stages of hydraulic fracturing operations.

Clause 18: An apparatus comprising: one or more processors; instructions to obtain, via one or more pressure sensors, pressure data indicating pressures in the borehole during stages of hydraulic fracturing; instructions to obtain well data indicating one or more well geometries and treatment data indicating one or more treatments for hydraulic fracturing; instructions to extract, via a plug movement detector, pressure-related features from the drilling data, well-related features from the well data, and treatment-related features from the treatment data; and instructions to output, by the plug movement detector, an indication whether the plug moved in the borehole based on the pressure-related features, well-related features, and treatment-related features.

Clause 19: The apparatus of clause 18, the instructions further comprising: instruction to output, by the plug movement detector, a prediction of torque that will be needed to remove the plug during a plug drill-out stage based on the pressure-related features, well-related features, and treatment-related features.

Clause 20: The apparatus of any one or more of clauses 18-19, the instructions further comprising: instructions to train the plug movement detector based on a training data set including pressure data samples indicating pressure measurements in the borehole from past stages of hydraulic fracturing, drilling data samples indicating drill bit measurements from past drill-out stages in the borehole, drilling data samples the indicate that the plug moved or did not move in the wellbore, well data samples indicating one or more well geometries of past stages of hydraulic fracturing, and treatment data samples indicating one or more treatments of past stages of hydraulic fracturing.

What is claimed is:

1. A method for identifying movement of a plug in a borehole of a well, the method comprising:

obtaining, via one or more pressure sensors, pressure data indicating pressures in the borehole during stages of hydraulic fracturing;

obtaining well data indicating one or more well geometries and treatment data indicating one or more treatments for hydraulic fracturing;

extracting, via a plug movement detector, pressure-related features from the pressure data, well-related features from the well data, and treatment-related features from the treatment data; and outputting, by the plug movement detector, an indication whether the plug moved in the borehole based on the pressure-related features, well-related features, and treatment-related features, wherein the pressure-related features include values for one or more of a hydraulic impedance at a well bottom in the well, a hydraulic inductance at a well bottom in the well, and a hydraulic capacitance at a well bottom in the well.

2. The method of claim 1 further comprising:

outputting, by the plug movement detector, a prediction of torque that will be needed to remove the plug during a plug drill-out stage based on the pressure-related features, well-related features, and treatment-related features.

3. The method of claim 1 further comprising:

performing inversion on the pressure data to determine the hydraulic impedance at a well bottom in the well, the hydraulic inductance at a well bottom in the well, and the hydraulic capacitance at a well bottom in the well.

4. The method of claim 1, wherein at least one of the pressure sensors is located at a wellhead of the well.

5. The method of claim 1 further comprising training the plug movement detector based on a training data set including:

pressure data samples indicating pressure measurements in the borehole from past stages of hydraulic fracturing, drilling data samples indicating drill bit measurements from past drill-out stages in the borehole, drilling data samples indicating whether the plug moved in the borehole, well data samples indicating one or more well geometries of past stages of hydraulic fracturing, and treatment data samples indicating one or more treatments of past stages of hydraulic fracturing.

6. The method of claim 5 further comprising:

extracting pressure-related feature samples from the pressure data samples; and labeling the pressure-related feature samples using the drilling data samples to indicate that the plug moved or did not move in the borehole.

7. The method of claim 1 further comprising:

modifying an aspect of one of the stages of the hydraulic fracturing or of a plug drill-out stage based, at least in part, on the indication that the plug moved; and performing, in the borehole, the modified aspect of the at least one of the stages of hydraulic fracturing operations.

8. The method of claim 1, wherein the plug movement detector is a trained plug movement detector, wherein the trained plug movement detector applies a classification algorithm to the pressure data to determine if the plug is in a feature space associated with plug movement, the classification algorithm trained using pressure data and drilling data.

9. One or more computer-readable media, the media including instructions that, when executed by at least one processor, identify movement of a plug in a borehole of a well, the instructions comprising:

instructions to obtain, via one or more pressure sensors, pressure data indicating pressures in the borehole during stages of hydraulic fracturing;

instructions to obtain well data indicating one or more well geometries and treatment data indicating one or more treatments for hydraulic fracturing;

instructions to extract, via a plug movement detector, pressure-related features from the pressure data, well-related features from the well data, and treatment-related features from the treatment data; and instructions to output, by the plug movement detector, an indication whether the plug moved in the borehole based on the pressure-related features, well-related features, and treatment-related features, wherein the pressure-related features include values for one or more of a hydraulic impedance at a well bottom in the well, a hydraulic inductance at a well bottom in the well, and a hydraulic capacitance at a well bottom in the well.

10. The one or more computer-readable media of claim 9 further comprising:

instruction to output, by the plug movement detector, a prediction of torque that will be needed to remove the plug during a plug drill-out stage based on the pressure-related features, well-related features, and treatment-related features.

11. The one or more computer-readable media of claim 9 further comprising:

instructions to perform inversion on the pressure data to determine the hydraulic impedance at a well bottom in the well, the hydraulic inductance at a well bottom in the well, and the hydraulic capacitance at a well bottom in the well.

12. The one or more computer-readable media of claim 9, wherein at least one of the pressure sensors is located at a wellhead of the well.

13. The one or more computer-readable media of claim 9, wherein at least one of the sensors is located at a wellhead of the well.

14. The one or more computer-readable media of claim 9 further comprising:

instructions to train the plug movement detector based on a training data set including pressure data samples indicating pressure measurements in the borehole from past stages of hydraulic fracturing, drilling data samples indicating drill bit measurements from past drill-out stages in the borehole, drilling data samples the indicate that the plug moved or did not move in the borehole, well data samples indicating one or more well geometries of past stages of hydraulic fracturing, and treatment data samples indicating one or more treatments of past stages of hydraulic fracturing.

15. The one or more computer-readable media of claim 14 further comprising:

instructions to extract pressure-related feature samples from the pressure data samples; and instruction to label the pressure-related feature samples using the drilling data samples to indicate that the plug moved or did not move in the borehole.

16. The one or more computer-readable media of claim 9 further comprising:

instruction to modify a plug drill-out stage or at least one of the stages of the hydraulic fracturing based, at least in part, on the indication that the plug moved; and instruction to perform, in the borehole, the modified aspect of the at least one of the stages of hydraulic fracturing operations.

17. The one or more computer-readable media of claim 9, wherein the plug movement detector is a trained plug movement detector, wherein the trained plug movement detector applies a classification algorithm to the pressure data to determine if the plug is in a feature space associated with plug movement, the classification algorithm trained using pressure data and drilling data.

18. An apparatus comprising:

one or more processors;

instructions to obtain, via one or more pressure sensors, pressure data indicating pressures in a borehole during stages of hydraulic fracturing;

instructions to obtain well data indicating one or more well geometries and treatment data indicating one or more treatments for hydraulic fracturing;

instructions to extract, via a plug movement detector, pressure-related features from the pressure data, well-related features from the well data, and treatment-related features from the treatment data; and instructions to output, by the plug movement detector, an indication whether the plug moved in the borehole based on the pressure-related features, well-related features, and treatment-related features, wherein the pressure-related features include values for one or more of a hydraulic impedance at a well bottom in the well, a hydraulic inductance at a well bottom in the well, and a hydraulic capacitance at a well bottom in the well.

19. The apparatus of claim 18, the instructions further comprising:

instruction to output, by the plug movement detector, a prediction of torque that will be needed to remove the plug during a plug drill-out stage based on the pressure-related features, well-related features, and treatment-related features.

20. The apparatus of claim 18, the instructions further comprising:

instructions to train the plug movement detector based on a training data set including pressure data samples indicating pressure measurements in the borehole from past stages of hydraulic fracturing, drilling data samples indicating drill bit measurements from past drill-out stages in the borehole, drilling data samples the indicate that the plug moved or did not move in the wellbore, well data samples indicating one or more well geometries of past stages of hydraulic fracturing, and treatment data samples indicating one or more treatments of past stages of hydraulic fracturing.

21. The apparatus of claim 18, wherein the plug movement detector is a trained plug movement detector, wherein the trained plug movement detector applies a classification algorithm to the pressure data to determine if the plug is in a feature space associated with plug movement, the classification algorithm trained using pressure data and drilling data.

* * * * *